United States Patent [19]

Bosson

[11] Patent Number: 4,790,086

[45] Date of Patent: Dec. 13, 1988

[54] METHOD OF SMOOTHING FABRIC

[76] Inventor: Ann-Britt Bosson, 526 Woodmont Ave., Berkeley, Calif. 94708

[21] Appl. No.: 88,164

[22] Filed: Aug. 21, 1987

[51] Int. Cl.[4] ..... D06F 59/02; D06F 83/00

[52] U.S. Cl. ..... 38/144

[58] Field of Search ..... 38/144, 140, 103, 111, 38/69, 70, 102.1, 102.91; 34/148, 151, 239; 69/19.1

[56] References Cited

U.S. PATENT DOCUMENTS

| | | | |
|---|---|---|---|
| Re. 16,194 | 11/1925 | Bass . | |
| 329,797 | 11/1885 | Wickham | 38/144 |
| 1,035,683 | 8/1912 | Brookman | 38/140 |
| 1,127,580 | 2/1915 | Bass . | |
| 1,453,697 | 5/1923 | Bass . | |
| 1,485,824 | 3/1924 | Bass . | |
| 1,527,513 | 2/1925 | Goldberg | 38/140 |
| 2,845,727 | 8/1958 | Schmitz | 38/140 |
| 3,222,730 | 12/1965 | Kalwaites . | |

*Primary Examiner*—Robert R. Mackey

*Attorney, Agent, or Firm*—Townsend and Townsend

[57] ABSTRACT

An apparatus, method and kit for ironing wrinkled fabrics or clothes without using heat or an iron is disclosed. A board is covered with furniture grade velour, bristle side facing upwards. The wrinkled article to be pressed is spread out on the upwardly facing velour bristles. The hands of the user are then placed against the article, palms down, and the article is pressed by the palms against the bristles. The article is then "ironed" using the operator's hands in a spreading motion to move wrinkles from the center of the article radially outward to the perimeter of the article. In this "ironing" process, the palms and fingers of the hands keep a downward force on the article as the wrinkles are spread to extinguishment at the perimeter of the article. When all of the wrinkles have been spread to and extinguished at the perimeter of the article, the article is lifted from the velour bristles and will be wrinkle free. In some instances, sprinking water on the article facilitates the ironing process.

3 Claims, 2 Drawing Sheets

METHOD OF SMOOTHING FABRIC

BACKGROUND OF THE INVENTION

This invention is related to removing wrinkles from fabrics or clothing, using a velour covered board and the operator's hands. Neither heat nor an iron is used.

A wrinkled article of clothing or fabric appears to have a memory that remembers where the wrinkle occurs. This memory can readily be demonstrated by taking a wrinkled handkerchief and flattening it out with one's hands on a smooth surface. As long as the hands hold the handkerchief in a flattened out position. the wrinkles appear to have gone away. However as soon as the hands are removed the handkerchief immediately contracts to its former, wrinkled state. In short, flattening out the wrinkled handkerchief did not erase the wrinkle memory.

The time honored technique of pressing wrinkled fabrics or clothing calls for an ironing board and a hot iron to remove the wrinkles from the fabric's memory. While this method certainly works, energy is needed to heat the iron, and the iron itself is heavy and laborious to use after a time. Even if the ironing board and iron are small in size, portability is hampered by the need for energy to heat the iron. The iron and ironing board technique uses brute force to erase the wrinkle memory: the heat and pressure sufficiently rearrange the fibers in the fabric during the hot pressing process. In short, a new pattern is impressed into the fabric's memory . . . a flat, ironed pattern.

SUMMARY OF THE PRIOR ART

Kalwaites (U.S. Pat. No. 3,222,730) discloses an apparatus and method for producing textile fabrics using a conveyor provided with a velour-type fabric surface which provides surface friction during formation. Bass (U.S. Pat. No. 1,127,580) and Bass (U.S. Re 16,194) disclose boards with beds of fine needles for pressing velour-type material. Bass (U.S. Pat. No. 1,453,697and Bass (U.S. Pat. No. 1,485,824) disclose pressing devices using stiff fine needles to hold the material to be pressed in place.

SUMMARY OF THE INVENTION

The present invention provides a velour covered board that is used to remove wrinkles from fabric or clothing without using heat or an iron.

A plywood or other firm board approximately 2'×2' in size, and ¼" or so in thickness is obtained. While the dimensions are not crucial, 2'×2 will just cover the top of a washing machine or dryer and allow the invention to be conveniently located atop a washer or dryer. Next, furniture grade velour having vertically oriented bristles of uniform height ranging from about 1/32" to 1/16" is mounted on the board. bristle side up. The velour is stretched slightly in both dimensions and mounted to the board by stapling, adhesive or other means. When properly mounted to the board, the velour bristles will stand vertically and will offer a resilient resistance if the hands of the user are placed atop the bristles and moved parallel to the board while pressing downward into the bristles.

The article to be ironed is spread flat on the bristles of the velour covered board. Tubular articles (such as a T-shirt) are spread on the bristles with the "front" of the shirt facing upward, and the "back" laying upon the bristles (or vice versa).

The palms and fingers of the user's hands are then brought into position over the wrinkled article that is spread on the velour bristles. The palms and fingers are used to press the upward facing surface of the article downward,toward the velour bristles. The hands start in the center of the upward facing surface of the article and move in a spreading motion radially outward, towards the perimeter of the article. The palms and fingers maintain a downward force against the surface of the article during the spreading motion. While the spreading can be accomplished with one hand. the use of two hands is considerably faster. Prior to the spreading motion it may facilitate the ironing process for the user to sprinkle water on the upward facing surface of the wrinkled article.

The velour bristles provide a degree of tactile feedback such that the user can feel when the fingers and palms are exerting just the right amount of downward spreading force. While the exact mechanism of the ironing process is not known, the following is believed to be true. Spreading the wrinkles with the hands, from the center of the top surface of the article radially outward, causes the wrinkles to be serially conveyed to the outer perimeter of the article. As this spreading process is carried out, the vertically oriented bristles in the velour appear to hold the spread article in a stretched and pressed disposition.

When all of the wrinkles have been conveyed to the perimeter of the article, the article is lifted away from the velour bristles and will be wrinkle free. The spreading action combined with the resilient resistance of the velour bristles has combined to remove the wrinkle memory from the fabric. It is a totally unexpected and surprising that the wrinkle memory is erased as a result o the spreading action and resilient resistance of the velour bristles.

Velour is commonly used as a furniture covering. It is a completely surprising and unexpected result that the subject method and apparatus removes wrinkles from fabric and clothing. Applicant serendipitously discovered the method and apparatus of the present invention while spreading wrinkled clothing on a velour covered couch, preparatory to ironing in the conventional manner. When the clothing was lifted from the velour covered couch, many of the wrinkles were gone. Some experimentation resulted in the selection of a proper grade of velour and a firm board over which the velour is placed.

Use of the present invention results in ironing in less time than would be the case using a conventional iron and ironing board. Since the present invention uses neither heat nor iron, there is no hazard of burning and scorching. Children may iron wrinkled clothing in total safety using the present invention. Since no heavy iron is used, the enfeebled may iron once more. Further, the present invention is portable and may be taken in a suitcase on trips.

The objects and advantages of the present invention are simply stated. The objective is to disclose a simple and portable apparatus for ironing without using heat or an iron, a kit for accomplishing the same, and to disclose a method for ironing without using heat or an iron. The advantages of the present invention are that it uses no heat and is therefore safe enough for children to use without fear of fire or scorching; it uses no iron and may be utilized by those too weak to handle a conventional heavy iron. Further the present invention is portable and may be carried in a suitcase while travelling. The most surprising advantage. however, is that the present invention irons clothing in less time and with less effort than would be the case using a conventional iron and board.

DETAILED DESCRIPTION OF THE PREFERRED EMBODIMENT

Figure 1A:
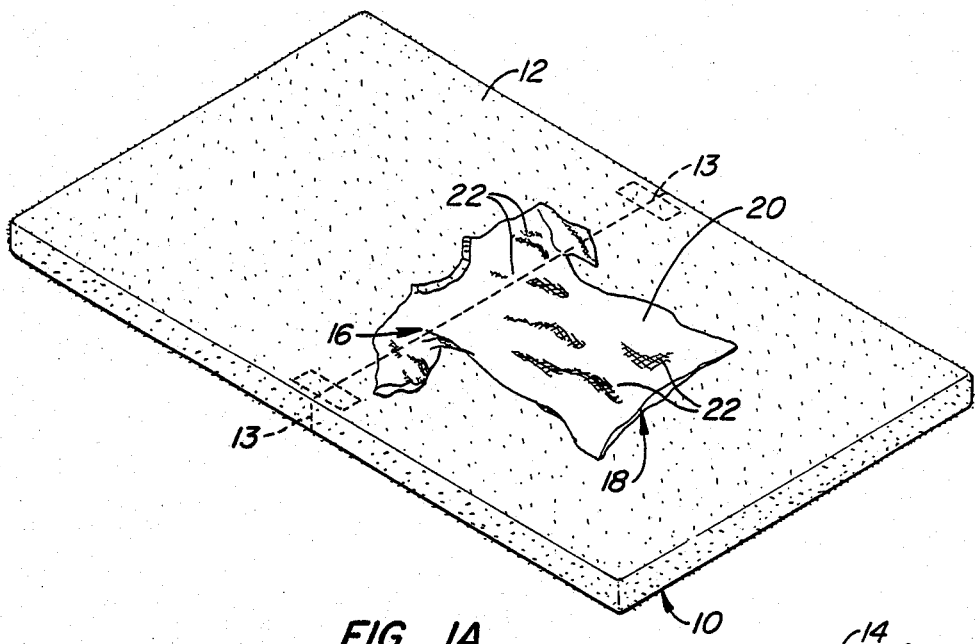
FIG. 1A is an overall perspective view of the preferred embodiment of the present invention, showing a velour covered board with a wrinkled article of clothing thereon.

Turning to FIG. 1A. a board 10 is covered with furniture grade velour 12, convenient size for board 10 is approximately $2' \times 2' \times \frac{1}{4}''$. These dimensions allow the board to be conveniently placed atop a washing machine or dryer. In one configuration, two such boards were medially hinged to allow them to be used atop an adjacent washer-dryer combination. Hinging means 13 allow board 10 to consist of two or more pieces, each medially hinged.

Figure 1B:
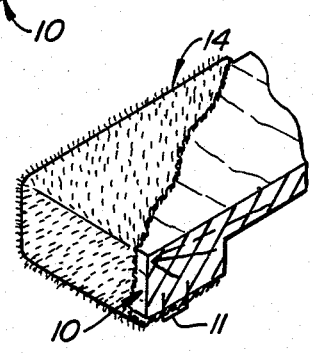
FIG. 1B shows in detail one corner of the velour covered board.

The velour has uniform height bristles 14 and is placed on the board with bristles 14 facing upward away from the board. The height of bristles 14 may be from 1/32" to 1/16". Velour 12 is stretched over board 10 and is secured to the board by use of staples 11. adhesives. Velcro TM tape or other mounting apparatus. While FIG. 1B demonstrates the use of staples 11 to secure velour 12 to board 10. other mounting devices may be used.

The wrinkled article 16 to be ironed is then laid upon upward facing bristles 14. Article 16 has a downward facing surface 18 and an upward facing surface 20 and a perimeter 28. Article 16 has a multitude of wrinkles 22 in surface 18 and surface 20. It is beneficial to next lightly spray surface 20 of article 16 with water, using a conventional water sprayer.

Figure 2:
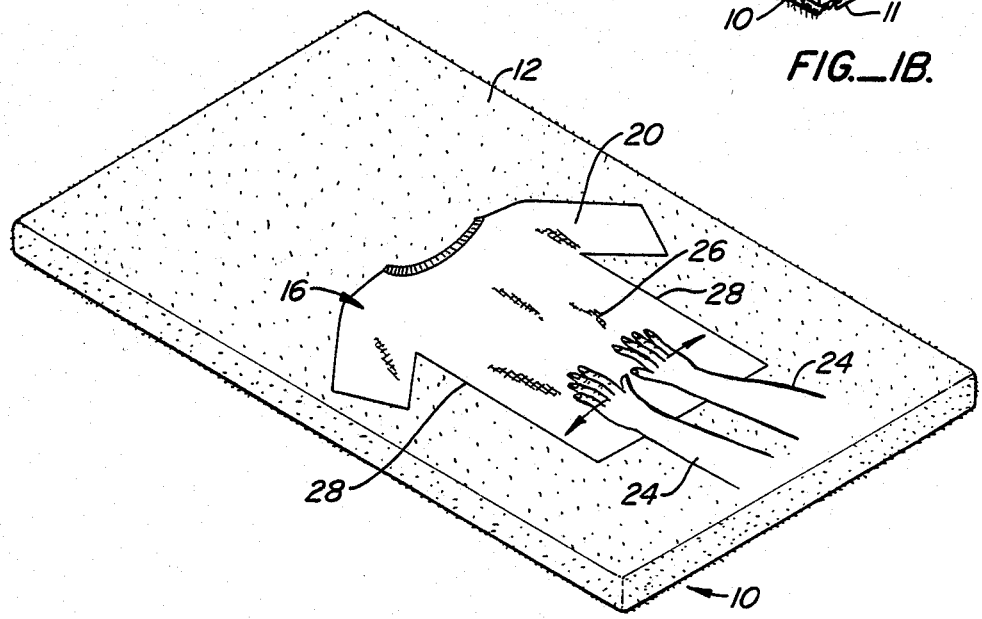
FIG. 2 shows the manner in which the user s hands spread the wrinkles radially outward.

Turning to FIG. 2 the user s hands 24 are brought into position over surface 20 of article 16. Although one hand may be used for the next procedure. two hands produce better results in shorter time. The user's hands 24 are placed palms downward atop surface 20, and press article 16 downward, into bristles 14 using the palms, fingers and thumbs. Maintaining a downwardly pressing force, the user's hands are then moved from a center position 26 on surface 20 radially outward towards perimeter 28 of the article in a spreading motion. The palms and fingers of each hand maintain a downward force at all times, and move in opposite directions. For instance in FIG. 2, as the right hand presses downward and moves to the right, the left hand presses downward and moves to the left.

The spreading motion of the user's hands conveys wrinkles 22 from central positions 26 on surface 20 to the perimeter 28 of the article. The spreading motion is repeated on all areas of surface 20 that contain wrinkles 22 until all wrinkles 22 are serially conveyed to perimeter 28.

Figure 3:
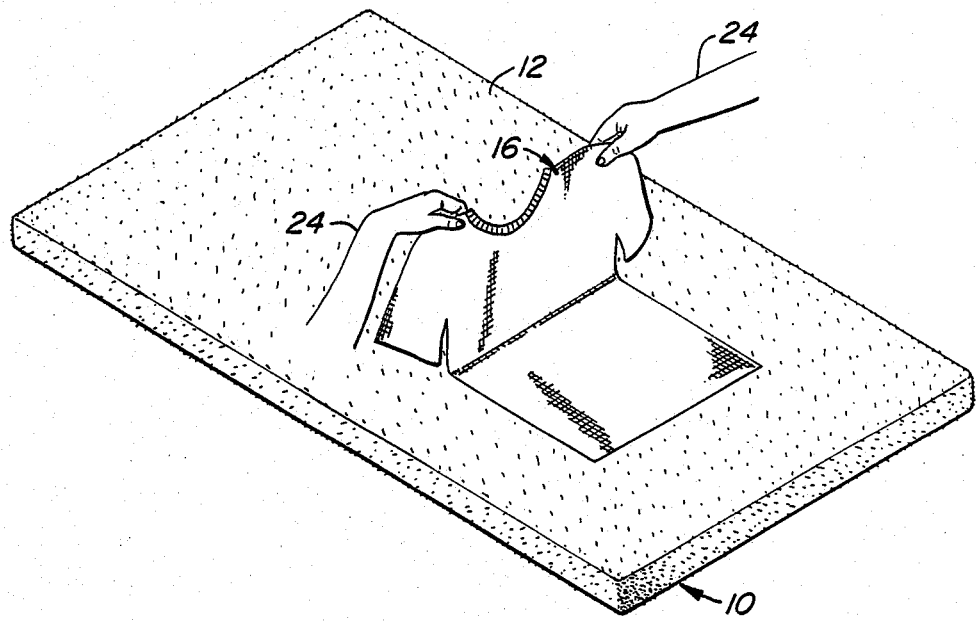
FIG. 3 shows the pressed article of clothing being removed from the velour covered board.

In FIG. 3, the spreading process has been repeated and all wrinkles 22 in surface 20 have been removed to perimeter 28. Article 16 my now be lifted off bristles 14. It is an unexpected and surprising result that upon being removed from bristles 14, article 16 will be wrinkle free on both surface 20 and surface 18.

The mechanics of the ironing process are not fully understood. Stretching velour 12 on board 10 causes bristles 14 to stand vertically upward and enables bristles 14 to engage and hold article 16 securely. The resilient resistance of bristles 14 holds both lower surface 18 and upper surface 20 of article 16 in a stretched and wrinkle free disposition during the spreading process. It is believed that wrinkles 22 from central positions 26 on surface 20 are serially conveyed to perimeter 28 by the spreading process and in the spreading process the memory wrinkle is erased. When article 16 is lifted off bristles 14, article 16 remains wrinkle-free In short, the article's wrinkle memory has been erased.

This result is surprising and unexpected and is achieved in less time and effort than would be the case using a conventional iron and ironing board. Further. the present invention uses neither heat nor heavy iron and is safe enough for children to use without fear of fire or scorching and is effortless enough for the enfeebled to use. Further, the present invention and is portable and convenient to use.

I claim:

1. A method of smoothing wrinkled fabric without the use of a heated pressing implement comprising:

stretching furniture grade velour over a board with the velour bristles facing upward away from the board, securing the stretched velour to the board, the velour characterized by a resilient, vertically standing bristle having a uniform bristle height of approximately 1/32" to 1/16";

providing a substantially dry article to be smoothed;

laying upon the upwardly, vertically standing bristles the article to be smoothed, the article to be smoothed having a downward facing surface that is in contact with the upwardly facing bristles, an upward facing surface that is opposite from the downward facing surface, a perimeter, and one or more wrinkles in the upward facing and downward facing surface;

pressing downwardly into the upward facing surface of the article to be smoothed with at least one of the user's hands;

moving the user's hand in a spreading motion while maintaining the downwardly pressing force, the spreading motion consisting of the hand moving from a center position on the upward facing surface of the article, radially towards and to the perimeter of the article;

serially conveying by the spreading motion wrinkles from center positions on the upward facing surface of the article, radially to and towards extinguishment at the perimeter of the article;

repeating the serial conveying by the spreading motion of the hand until all wrinkles in the upward facing surface of the article have been serially conveyed to extinguishment at the perimeter of the article;

removing the article from the bristles in a smoothed wrinkle free condition.

2. The method of claim 1 further comprising:

pressing downwardly into the upward facing surface of the article to be smoothed with both of the user's hands;

moving each of the user's hands in a spreading motion while maintaining the downwardly pressing force, the spreading motion consisting of the hands moving in opposite directions from one another, from a center position on the upward facing surface of the article, radially towards and to the perimeter of the article.

3. The method of claim 1 further comprising:

spraying the wrinkled fabric with a water mist before the spreading process.

* * * * *